US005552766A

United States Patent [19]

Lee et al.

[11] Patent Number: 5,552,766

[45] Date of Patent: Sep. 3, 1996

[54] ANTI-CRIME SECURITY SYSTEM

[76] Inventors: Jung K. Lee; Yong H. Lee, both of 2209 Old Bosley Rd., Timonium, Md. 21093

[21] Appl. No.: 197,888

[22] Filed: Feb. 17, 1994

[51] Int. Cl.[6] ..... G08B 13/00

[52] U.S. Cl. ..... 340/541; 109/3; 340/551; 340/825.34; 382/124

[58] Field of Search ..... 340/541, 545, 340/551, 555–57, 666, 538, 825.31–825.34, 572; 379/40; 382/4, 124; 109/3–8

[56] References Cited

U.S. PATENT DOCUMENTS

| | | | |
|---|---|---|---|
| 3,701,100 | 10/1972 | Yarbrough | 340/825.31 |
| 4,060,039 | 11/1977 | Lagarrigue | 340/551 X |
| 4,091,366 | 5/1978 | Lavallee | 340/524 |
| 4,446,454 | 5/1984 | Pyle | 340/538 |
| 4,481,887 | 11/1984 | Urbano | 109/3 |
| 4,612,221 | 7/1984 | Schandle et al. | 340/539 X |
| 4,812,841 | 3/1989 | Chen | 340/825.31 |
| 5,018,096 | 5/1991 | Aoyama | 340/825.31 X |
| 5,083,122 | 1/1992 | Clark | 340/825.32 |
| 5,325,084 | 6/1994 | Timm et al. | 340/541 |

*Primary Examiner*—Thomas Mullen

[57] ABSTRACT

An anti-crime security system which provides an entrance and an exit to an establishment, wherein the entrance and exit define an enclosed area, provides sensors to monitor ingress and egress through the enclosed area, and monitors activity in the enclosed area and controls access to the establishment based on the ingress, egress, and activity monitored by the sensors.

20 Claims, 5 Drawing Sheets

FIG. 7

SETTING CONTROL PARAMETER

| SOMEONE IN ENCLOSED AREA | SOMEONE NOT IN ENCLOSED AREA |
|---|---|
| PASSWORD : AUTO DOOR OPEN (BY SOFTWARE) | PASSWORD + 001 : MODE 1<br>PASSWORD + 002 : MODE 2<br>PASSWORD + 003 : MODE 3<br>PASSWORD + 004 : MODE 4 |
| A + PASSWORD : A DOOR OPEN | |
| B + PASSWORD : B DOOR OPEN | PASSWORD + 100 : TIME SET<br>PASSWORD + 101 : TIMER 1<br>PASSWORD + 102 : TIMER 2<br>PASSWORD + 103 : TIMER 3<br>PASSWORD + 104 : TIMER 4<br>PASSWORD + 105 : TIMER 5 |
| PASSWORD + EMERGENCY KEY : OPEN DOOR & SET WARNING STATUS | |
| PASSWORD : (IN WARNING STATUS)<br>① METAL DETECTOR FLAG SET : CANCELLATION IS PERMITTED BY HAVING THE AMOUNT OF METAL THAT WAS DETECTED COMING IN, EQUAL THE AMOUNT OF METAL LEAVING.<br>② PERMISSIVE SETUP 2 : THE NUMBER OF PERSONS EXITING THE ESTABLISHMENT MUST BE EQUAL TO THE AMOUNT KEYED IN BY THE OPERATOR. | PASSWORD + 200 : PASSWORD SET |
| | PASSWORD + 300 : AUTO DIALER TIME DELAY IN WARNING STATUS<br>PASSWORD + 301 : TIME DELAY FOR CANCELLING WARNING STATUS IN MODE 2<br>PASSWORD + 302 : PERMISSIVE TIME DELAY FOR WARNING STATUS (SETUP 1)<br>PASSWORD + 303 : TIME DELAY FOR CANCELLING WARNING STATUS AFTER ACTIVATION OF AUTO DIALER |
| | PASSWORD + 400 : PERMISSIVE CONTROL SETUP |

FIG. 9

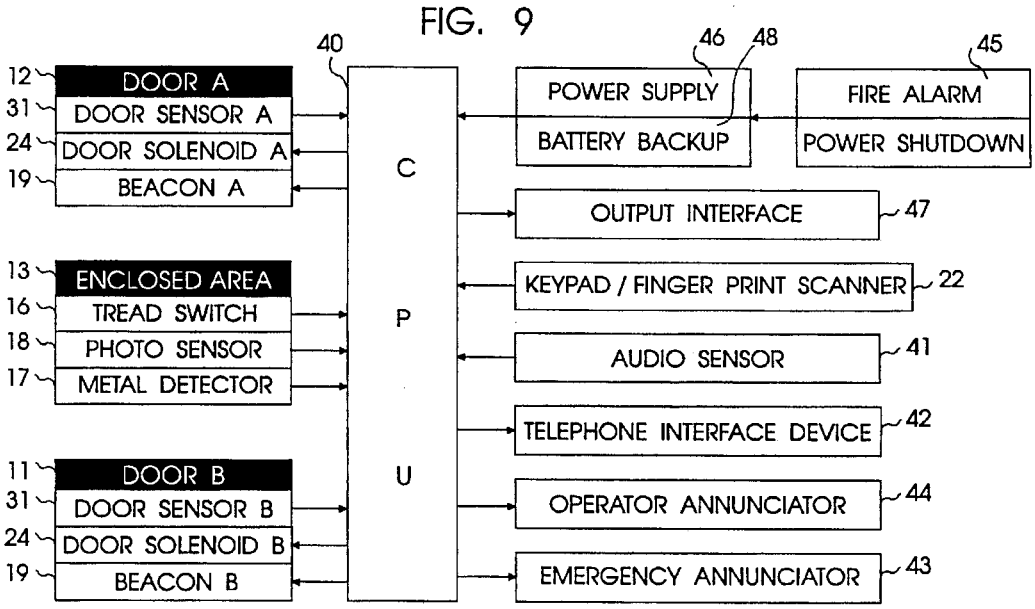

ANTI-CRIME SECURITY SYSTEM

BACKGROUND OF THE INVENTION

1. Field of the Invention

The present invention relates to an anti-crime security system, and more particularly, to a crime deterrent system which includes double doors and a computer controlled system to lock and unlock the doors based on sensor input of prevailing conditions. The system will prevent criminal activity two ways, one by actually detecting the possibility of weapons on persons attempting to enter a building and limiting their ingress, and secondly, by deterring even an attempt at criminal activity, by having the would-be perpetrator know of the serious limitations to a successful escape after having committed a crime.

2. Description of Related Art

Many types of anti-crime security systems are known in the art. For example, conventional systems include a single door having an electrical locking system for opening and closing the single door by pushing a button. However, when a thief obtains access to an inside area protected by the single,door by inserting a wedge into an opening in the door, the thief can escape through the single door in the same manner in which he entered. As a result, such door systems cannot prevent the thief from fleeing by confining him in a secure area and furthermore cannot detect a firearm concealed by the thief.

SUMMARY OF THE INVENTION

Accordingly, it is an object of the present invention to provide an anti-crime security system which eliminates the above problems encountered with conventional anti-crime security systems and provides additional incentive to deter criminal activity.

Another object of the present invention is to provide an improved anti-crime security system which includes double doors, an enclosed space formed by the two doors, a remotely controlled electric lock attached to each door, and access to property protected by the system, is subject to various situations, up to and including entrapment within the two door enclosure.

A further object of the present invention is to provide an anti-crime security system which further includes a tread switch at the bottom of the enclosure for detecting the presence of a person within the enclosure, an invisible infrared photoelectric sensor for additional verification of the presence of a person, and a metal detecting device for detecting the presence of guns or other metal weapons.

The above objects, as well as other objects, are fulfilled by providing an anti-crime security system, comprising:

access means for providing an entrance and an exit to an establishment and for defining an enclosed area;

sensor means for monitoring ingress and egress through said access means and for monitoring activity in said enclosed area; and central processing means for controlling said access means based on the ingress, egress, and activity monitored by said sensor means.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus, are not limitative of the present invention, and wherein:

FIG. 7 illustrates setting control parameters utilizing a password when a person is in the enclosed area and when a person is not in the enclosed area;

FIG. 9 illustrates the central processing unit and its interfaces to other elements of the security system of the present invention;

DETAILED DESCRIPTION OF THE PREFERRED EMBODIMENTS

The anti-crime security system of the present invention provides a proprietor whose establishment is protected by the anti-crime security system with a means of protecting, not only his business and inventory, but also provides a measure of safety and security for the proprietor and his employees. The anti-crime security system is intended to not only decrease the probability that a perpetrator will successfully carry out a crime, but also, to create a psychological disincentive to dissuade criminals from attempting to commit a crime in the protected establishment. If the perpetrator knows that it will be very difficult to carry a weapon into an establishment protected by the anti-crime security system of the present application, and if the perpetrator knows that escape will be thwarted by locked doors, automatic alarms, and the possibility of being entrapped within the double doors, the perpetrator will be dissuaded from attempting to commit a crime in the protected establishment.

Figure 1:
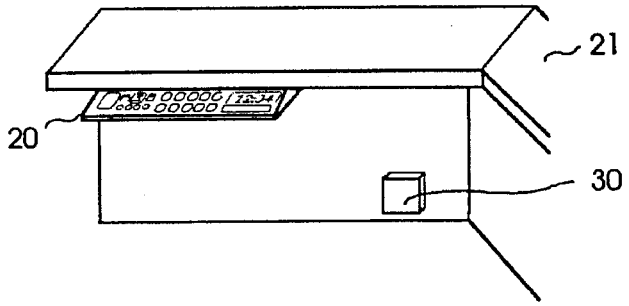
FIG. 1 is a perspective view of a control area having a control panel for the anti-crime double door security system of the present invention.
Figure 3:
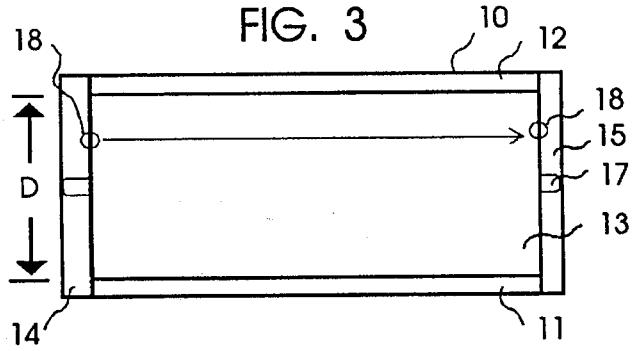
FIG. 3 is a top plan view of the anti-crime security system and enclosed space of the present invention.
Figure 5:
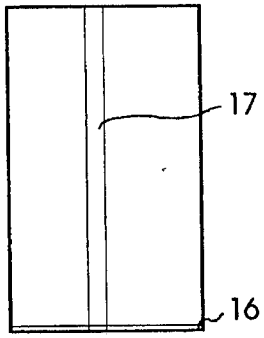
FIG. 5 is a side elevational view of the anti-crime security system of the present invention.
Figure 4:
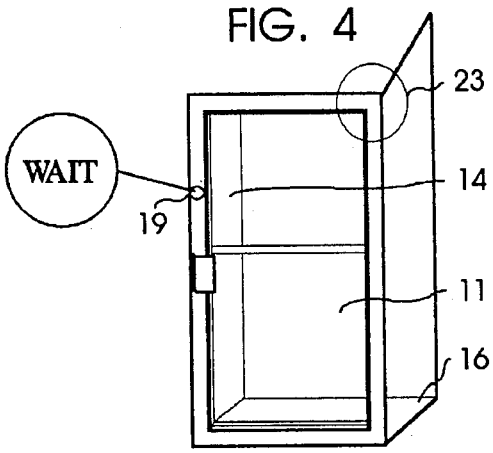
FIG. 4 is a front perspective view of an inside door of the anti-crime security system of the present invention.

As discussed above, the present application is directed to an anti-crime security system which includes a double door member 10 illustrated in FIG. 3, a control station 20, illustrated in FIG. 1, and a computer system 30, illustrated in FIG. 1 to lock and unlock the double door member 10 based on sensor input of prevailing conditions. The system prevents criminal activity two ways: one, by actually detecting the presence of weapons on persons attempting to enter the protected establishment and limiting their egress, and two, by deterring attempted criminal activity, by making a potential perpetrator aware of the low probability of successful escape from the establishment after having committed a crime.

Figure 6:
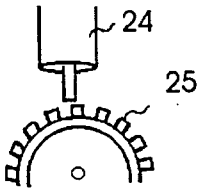
FIG. 6 illustrates a door locking mechanism of the anti-crime security system of the present invention.

The anti-crime security system, as illustrated in FIGS. 1–6, includes the double door member 10 including an outer door 11 with an electric lock and an inner door 12 with an electric lock which is mounted D (typically several) feet from the outer door 11. The two doors 11 and 12 form an enclosed area 13 with two sidewalls 14 and 15 at either side. At the bottom of the enclosed area 13, is located a tread switch 16, illustrated in FIGS. 4 and 5, which detects a person standing in the enclosed area 13 and provides a signal to the computer system 30 indicating a person is within the enclosed area 13. Within the enclosed area 13 is also an infrared photoelectric source and receiver 18 for detecting a person standing in the enclosed area 13 and providing a second signal to the computer system 30 that a person is in the enclosed area 13. A metal detector 17 with an adjustable trigger level is also provided for scanning the enclosed 13 area in order to measure an amount of metal within the enclosed area 13 which may indicate the presence of a gun or other metallic weapon. Both the inner and outerdoors 11 and 12 include a door potentiometer sensor 31, illustrated in FIG. 9, which detects a position of the doors and sends a signal to the computer system 30 indicating the position of each door. The door locking mechanism 23, illustrated in FIG. 4, includes a door solenoid 24 and a plurality of teeth 25 for engaging the door solenoid 24 as illustrated in FIG. 6 and a door locking mechanism 23. Each door also includes a signal beacon 19 to indicate to persons waiting to pass through the enclosed area 13 whether the door 11 or 12 may be opened or not.

The anti-crime security system of the present application also includes the control panel 20 with a keypad 22 (illustrated in FIG. 2) and a plurality of switches, including a fingerprint identifier 32 which can be located remotely from the door system at a convenient location within the establishment being protected by the anti-crime security system. The control panel 22 is controlled by an operator, who is usually the owner or another trusted employee of the establishment being protected. The control panel 22 allows the operator to interact with the computer system 30, including a CPU 40 (illustrated in FIG. 9), memory, IO devices, and power supply, which controls the operation of the anti-crime security system. The computer system 30 locks certain doors and generates certain warnings, as will,be discussed below, based upon inputs from the tread switch 16, infrared photoelectric source and receiver 18, and metal detector 17, and modes of operation, which will also be discussed below, selected by the operator.

The anti-crime security system also includes a telephone interface device 42 (illustrated in FIG. 9), capable of automatically calling an alarm company and notifying them of an alarm condition at the establishment being protected. The anti-crime security system also includes an audio sensor 41 for detecting loud sounds, such as a gun shot, and sending a signal to the computer system 30 when a loud sound has been detected. The anti-crime security system of the present application also include an emergency annunciator 43 which can be heard by the operator as well as by any persons entering or leaving the double door system and an operator annunciator 44 which can be heard by the operator of the system and generally can not be heard by persons in the anti-crime security system The system further includes a fire alarm 45, which detects a fire within the establishment and disconnects the power supply 46 to the computer system 30. When the power supply is disconnected, both doors are prevented from being locked or if locked, will unlock. This acts as a safety precaution to prevent anyone from being entrapped by the anti-crime security system during a fire emergency. The system also includes an output interface 47 which permits electrical locking of all doors of the establishment when the system is in the Warning Status. Finally, the anti-crime security system of the present application includes a warning sign mounted on the front of the outer door 11 of the protected establishment warning persons considering criminal activity to the presence of the present system and advising them of the consequences of their considered criminal activity.

In the anti-crime security system of the present application, there are four modes of operation available for selection by the operator. These four modes may be manually selected by the operator or may be preprogrammed such that a certain mode is entered at a certain time of the day. Further, multiple mode selections may be pre-timed automatically. A mode is defined as a series of events that will occur as a result of sensor inputs to the computer system 30 from the various input systems of the anti-crime security system. The purpose of the different modes of operation is to allow the security system to react differently to situations which may occur at different periods of the day. The operator may wish to select one mode of operation if alone in the establishment with only an occasional person entering. The operator may choose a different mode if several employees are also present or if there are several persons in the establishment.

The anti-crime security system operates on 115 VAC (nominal) household current and has a battery backup system 48 in case of a power failure. The input from a fire detector disconnects the computer system power supply 46 in the event of a fire in the protected establishment, which disables the door locking capabilities of the system. This is done to ensure that the doors can be opened during a fire emergency. The operator of the system controls the function of the system at a control panel 20 which may be mounted at a convenient location in the protected establishment. Many of the operator functions require the use of a password or fingerprint. This is done to prevent an unauthorized person from controlling the system, even if the operator is physically overpowered by someone attempted to operate the system.

The system will automatically enter the Warning Status if the control panel 20 becomes damaged or disconnected from the computer system 30. In order to arm the system, the operator will select a mode of operation. In any mode of operation that has been selected, if the emergency key 33 (illustrated in FIG. 2) on the front of the control panel 20 is depressed or the audio sensor 41 detects an unusually loud noise, such as a gun shot or other violent disturbance, the system will automatically switch to the Warning Status. The computer system 30 can be overridden by the operator. If the operator wishes to open the outer door 11 out of normal automatic sequence, he may depress a "B" push button (throughout the remainder of the specification and in FIGS. 8, 10, and 11, "B" represents the outer door 11 and "A" represents the inner door 12) and key in his password or fingerprint. The operator may also open the inner door 11 by depressing the "A" push button and keying in his password or fingerprint. The operator may unlock either door only if the tread switch 16 and the photoelectric source and receiver 18 detect a person in the enclosed area 13 and both doors 11 and 12 are closed.

The purpose of this function is to protect the operator by ensuring that the person is in the enclosed area 13 when a door is unlocked. If the operator wishes to open a door as part of a normal sequence of the one of the modes of operation, the operator need only key in his password or fingerprint. The operator annunciator 44 generates an audible signal to the operator, which signals the presence of a person in the enclosed area 13. The operator annunciator audible signal is a lower volume, non-emergency audible alarm. Another high volume emergency annunciator 43 provides an emergency audible alarm, when the metal detector 17 is activated. This is intended to provide a psychological deterrent to any person contemplating criminal activity.

Figure 2:
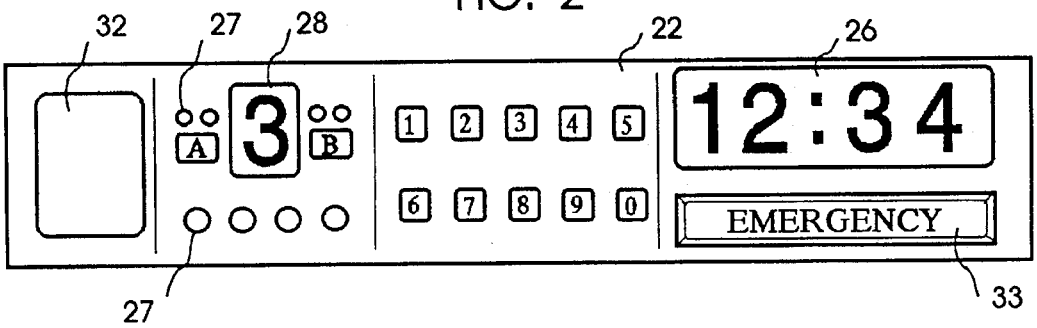
FIG. 2 is an enlarged top plan view of the control panel of the anti-crime security system of the present invention.

The anti-crime security system of the present application may be accessed either by the finger print scanner 32 or a keypad 22. As illustrated in FIGS. 1 and 2, a keypad 22 is provided, where a secret password may be entered. The secret password may be a 1 to 4 digit number. The password may be selected by using either four constant numbers, or in order to further protect access to the control panel 20, any of the digits may be a constant number and any of the numbers can vary with a system time clock 26. For example, the operator could select a constant number for the first, second, and third digits, but vary the fourth digit, according to either the hour indicator or the minute indicator of the system time clock 26, in order to vary the secret code with time. Any or all of the four digits may be varied with the system time clock 26, thereby affording greater protection to the operator since the password would not be constant and there would be no chance of anyone copying the number.

For example, the operator may wish to set up a three-digit password with the following characteristics. The operator wants the first digit to be a variable digit tied to the first digit of the system time clock 26 and the second digit to be a constant number 5. Further, the operator would like the third digit to be a variable digit tied to the fourth digit of the system time clock 26. In order to set up such a three digit password, the operator would first press "1" than "A" at the control panel 20 illustrated in FIG. 2. The "A" means that this digit is variable and tied to the system time clock 26. The "1" means the value of the digit should be tied to the first digit of the system time clock 26. The operator then presses "5" as a constant number. Further, the operator presses "4", the "A". "4" means that the digit should be tied to the fourth digit of the system time clock 26. The operator presses "B" to finish setting the password. If the time clock shows 08:26, then the password reads 056. One minute later, when the clock shows 08:27, the password is 057. Two hours later when the time clock shows 10:27 the password is 157.

FIG. 7 illustrates the setting of various control parameters utilizing the password when a person is in the enclosed area 13 and when a person is not in the enclosed area 13. As indicated in FIG. 7 by entering "A+PASSWORD" only the inner (A) door 12 may be opened. Similarly, by entering "B+PASSWORD", only the outer (B) door 11 is opened. By entering the password and then pressing the emergency key 33, either the inner (A) door 12 or the outer (B) door 11 may be opened and the security system enters the warning status.

When the password is entered in the warning status and the metal detector flag is set, cancellation of the warning status is permitted by having the amount of metal detected by the metal detector 17 coming in equal the amount of metal detected leaving Further, in permissive setup 2, which is described below cancellation of the warning status may be achieved if a number of persons exiting the establishment are equal to a number of persons entered by the operator.

When a person is not in the enclosed area 13, the password plus a three digit number modifies the current mode of the security system. Further the password plus a second set of three numbers allows the operator to set the system time clock 26 and to set a plurality of predetermined time periods. Finally, the password plus a third set of three digit numbers allows the operator to change the password and to set a plurality of time delays for various central processing unit functions.

The operation of the anti-crime security system of the present application will now be described with reference to FIGS. 8, 10, and 11.

Figure 8:
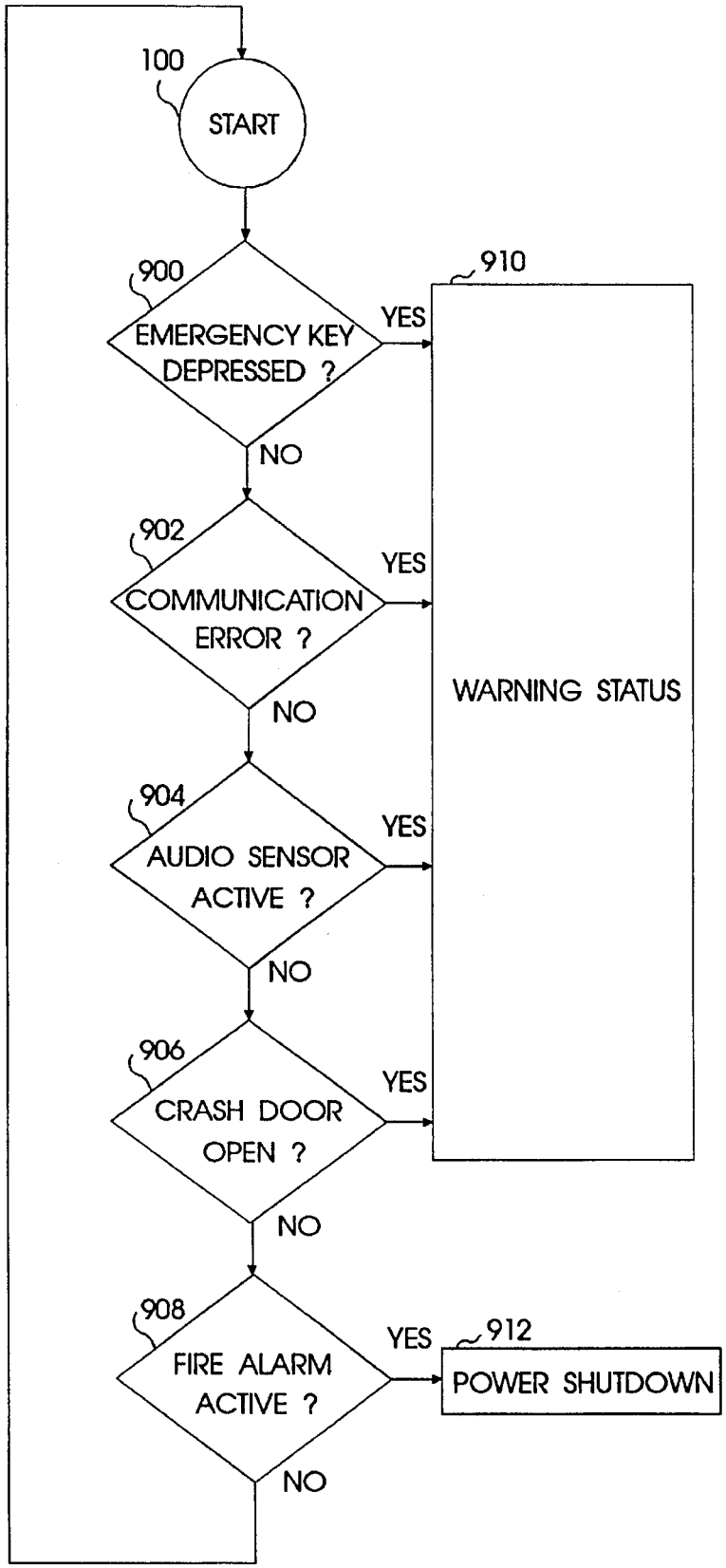
FIG. 8 illustrates the basic functions of the security system and mode 1 operation.

In each mode of the anti-crime security system of the present application, six basic functions are applicable. These basic functions include:

1. detecting a crash door opening, which invokes the Warning Status (step 906 of FIG. 8). A crash door opening is defined as an unusually fast opening of either door 11 or 12, indicating unusual haste of the person using the door;
2. utilizing the emergency key 33 which allows the operator to place the security system in the Warning Status at any time (step 900 of FIG. 8);
3. setting the audio sensor 41 so that any detection of an unusually loud sound will place the system in Warning Status at any time (step 904 of FIG. 8);
4. disabling the computer power supply and preventing either of the double doors 11 or 12 which are a part of the security system or any other automatic lock switch controlled by the output interface from locking, when the fire detector is activated (step 908 of FIG. 8);
5. providing an output interface 47 which provides a signal to lock all doors in the establishment when the Warning Status is entered; and
6. invoking the Warning Status via the computer system 30 when the control panel 20 is damaged or disconnected. The warning status is invoked by a communication error between the CPU 30 and the control panel 22, as indicated in step 902 of FIG. 8.

The anti-crime security system of the present application includes four modes and the Warning Status. Mode 1 allows unrestricted entrance to the establishment, except the six (6) basic functions described above apply. Mode 2 retains the basic functions, but also detects a weapon in the enclosed area 13. Mode 3 retains the basic functions, but stops a person on whom a weapon was detected, and requires the operator to make a judgement as to whether that person may enter the establishment. Finally, mode 4 retains all of the basic functions as well as the weapon detection of mode 2, but stops all persons from entering and leaving the establishment, regardless of sensor activity. Mode 4 requires that the operator, after becoming aware of sensor information, make a judgement as to whether or not to permit entry of each and every person.

Modes 1–4 and the Warning Status are provided so that the system reacts differently to different situations. Generally, mode 2 is the lowest security level which utilizes all of the basic functions. Modes 3 and 4 are variations on mode 2, which allow the operator to control the level of security consistent with the time of day and other conditions within the establishment, either by utilizing the system time clock 26 to engage these modes in response to a preset time or manually selecting the different modes of operation. For example, in daytime with many people in the establishment, when there is virtually no risk of criminal activity, the system time clock 26 could be set so that mode 1 would be engaged. When there is a high risk of criminal activity occurring, such as at night, when the operator is alone, the system time clock 26 could be set so that mode 4 would be engaged.

The Warning Status is distinguished from the other modes 1–4, since modes 1–4 are schemes for setting the security system, where upon, by either triggering the sensors or manual input, the Warning Status is engaged. The Warning Status overrides all other modes.

In one embodiment of the preferred invention, mode 3 is the default mode. Both mode 3 and mode 4 require more operator intervention, which provides a higher level of security. Mode 2 is the lowest security level with all sensors active. An example of mode 2 operation is provided below and illustrates sensor functions and system reaction to a hypothetical situation.

In this example, a gunman has entered the establishment. The emergency annunciator 43 has alerted the operator and the gunman, however, the gunman chooses not to exit through the outer door 11. Mode 2 allows the gunman to pass through the inner door 12 and enter the establishment. When the gunman passes through the inner door 12, the operator annunciator 44 alerts the operator that the gunman has entered and enters the Warning Status.

In the Warning Status, the outer door 11 is locked and all other doors in the establishment are automatically locked by an electrical output from the output interface 47. If the operator believes that the gunman is not a threat, namely the gunman may be a policeman, the operator may key in his password or fingerprint and cancel the Warning Status before a countdown timer prohibits cancelling the Warning Status.

Assuming the gunman is not a policeman, the gunman enters the premises and attempts to rob the operator, because the system is in Warning Status. If the gunman kills the operator, he will be entrapped in the enclosed area 13 when attempting to leave. As a result, because the gunman knows he cannot escape if he kills the operator, he may attempt to force the operator to open the outer door 11. However, the operator is incapable of opening the outer door 11 unless the gunman enters the enclosed area 13 and activates the tread switch 16 and infrared photoelectric source and receiver 18. Further, both the inner and outer doors 11 and 12 must be closed. Only when these conditions are met, may the system allow the operator to open either the outer door 11 or the inner door 12.

The gunman now has two choices: first, shooting the operator, thereby entrapping himself, since upon passage of a certain preset amount of time, the telephone interface device 42 for the alarm company would be activated and the police would arrive and arrest the gunman. The second more logical choice for the gunman would be to follow the orders of the operator and enter the enclosed area 13. Once the gunman has entered the enclosed area 13, the operator has control of the situation. The operator may now entrap the gunman inside the enclosed area 13 and call police or let the gunman exit through the outer door 11.

Alternatively, the gunman, having heard of the existence of the present system, may enter the establishment and after having committed robbery, may order the operator to turn off the Warning Status. In this situation, because the Warning Status was triggered through mode 2, and a certain weight of metal was detected, indicating that a gun or guns have been brought in, unless the gunman leaves the premises with the same weight of metal, indicating that all guns that came in have left, the system remains in the Warning Status. If the metal detector 16 has detected entry of a gun or guns, it must also detect the exiting of the same number of guns to cancel the Warning Status. Since activation of the metal detector 16 in the first instance would trigger the Warning Status, the outer door 11 would be locked and hence no one would be able to enter the establishment. The next detection of a gun or metal object would have to be the gunman's gun or other weapon, while the gunman would be attempting to exit.

Even though it s impossible to cancel the Warning Status, suppose, that the Warning Status has been deactivated. The gunman is faced with two choices;

1. leaving the premises; or
2. shooting the operator.

The audio sensor 41 would detect any unusually loud sound, such as a gun shot, and automatically trigger the Warning Status again. Therefore, if the gunman were to shoot the operator, he would be once again entrapped in the enclosed area 13. If the gunman were to simply leave without firing a shot, the operator can activate the Warning Status again by pressing the emergency key 33 if desired. If the gunman were to shoot the control panel 20 or otherwise attempt to disable it by cutting the wires, the computer system 30 would automatically invoke the Warning Status. The Warning Status is automatically invoked when the computer system 30 can no longer communicate with the control panel 20.

It is apparent from the above description, that if several gunmen were to enter the premises and the Warning Status was engaged, the last gunman to leave the premises would be trapped. Due to the fact that the metal detector 17 measures the amount of metal that has entered, it in effect "counts the guns" that have entered. The metal detector 17 would also measure the amount of metal leaving,in effect, "counting the guns that left". The Warning Status can not be cancelled until all the guns left equals the number of guns that had entered.

The primary purpose of the anti-crime security system of the present application is to deter crime. There are several ways this invention meets that primary purpose. Criminals usually search for potentially easy targets. They usually scout out their potential target and determine the level of difficulty in carrying out a successful crime, which includes an easy escape route. Should a criminal come into a establishment, which has the anti-crime security system of the present invention, they would immediately see the unusual door system, and other signs that would indicate difficult entry from the enclosed area 13. It is likely that they would be dissuaded from attempted criminal activity in such an establishment. Further, if a criminal does enter the establishment carrying a gun and hears the emergency annunciator 43 that is triggered, he would be inclined to run away, rather than follow through with the crime. If the criminal were to follow through and commit the crime, the system has the capability to actually detain the criminal until police arrive. The output interface 47 connected to the computer system 30 permits electrical locking of all the doors in the establishment during the Warning Status. Therefore, any attempt at using any other door in the establishment, by the criminal, would be futile, since the output interface 47 would block all routes of escape.

Modes 1–4 as well as the Warning Status will now be discussed in more detail, with reference to FIGS. 10 and 11.

In mode 1, both the outer door 11 and the inner door 12 are always unlocked, only the six basic functions, discussed above, remain active.

Mode 2 retains the basic functions as mentioned above, however, when a person opens the outer door 11, the inner door 12 immediately locks and the beacon 19 indicates "WAIT" in the inner door 12. Conversely, if the inner door 12 is opened, the outer door 11 immediately locks and a beacon 19 indicates "WAIT" on the outer door 11. This ensures that both doors can not be opened at the same time. When a person is in the enclosed area 13 and is verified by the tread switch 16 and the infrared photoelectric source and receiver 18, and the metal detector 17 is activated by the presence of metal, which may indicate a gun or other metallic weapon, the system switches from mode 2 to the Warning Status. At this time, the emergency annunciator 43 will signal the operator and the person in the enclosed area 13 with a high level emergency audible alarm, which will provide a psychological deterrent to a person contemplating criminal activity. Switching to the Warning Status will also cause the outer door 11 to lock. The control panel 20 will then display a countdown from a programmable number of seconds and provide a low level audible alarm to the operator. If the operator does not cancel the Warning Status, by keying in a password or fingerprint before the countdown timer reaches zero, the system will stay in the Warning Status. If the metal detector 17 did not activate when the person was in the enclosed area 13, that person can then pass through the inner door 12, again locking the outer door It upon opening the inner door 12 and enter the establishment or return through the outer door 11 (locking the inner door 12 upon opening the outer door 11) to exit without further operator intervention.

Mode 3 retains the basic functions, and as in mode 2, both the outer door 11 and inner door 12 begin in an unlocked condition. When a person opens the outer door 11, the inner door 12 immediately locks and the beacon 19 indicates "WAIT" on the inner door 12. Conversely, if the inner door 12 is open, the outer door 11 immediately locks with a "WAIT" beacon 19 on the outer door, in order to ensure that both doors can not be opened at the same time. Mode 3 requires that anyone entering or leaving the establishment be present in the enclosed area 13 until the door through which he used to enter the enclosed area 13 recloses. Once the person is in the enclosed area 13 and the door he used to enter is closed, the person may proceed into the establishment or re-exit without having to wait for the operator to key in a password to allow passage. While the person is in the enclosed area 13, if the metal detector 17 is activated, indicating the possibility of a gun or other metallic weapon on the person in the enclosed area 13, unlike mode 2 where the Warning Status is evoked, the inner door 12 will lock. This time the audible alarm will signal the operator and the person in the enclosed area 13 with the high level emergency audible alarm which will provide a psychological deterrent to the person contemplating criminal activity. The person will not be able to proceed without the operator releasing the inner door 12 by keying in a password or a fingerprint. If the operator wishes to enter the Warning Status, this may be done, by, in addition to entering his password or fingerprint, also pressing the emergency key 33 which will then set the system to the Warning Status. Mode 3 provides the highest level of security with the lowest level of operator intervention so it is therefore the default mode that the system will enter if a mode has not been selected.

Mode 4 retains the basic functions and both the outer door 11 and the inner door 12 are in an unlocked condition as in modes 2 and 3. When a person opens the outer door 11, the inner door 12 immediately locks and the beacon 19 indicates "WAIT" on the inner door 12. Conversely, if the inner door 12 opens, the outer door 11 immediately locks with a "WAIT" beacon 19 on the outer door 11, in order to ensure that both doors are not opened at the same time.

When a person enters through the outer door 11 into the enclosed area 13 (the inner door 12 has been locked by opening the outerdoor 11) and is detected by the tread switch 16 and verified by the infrared photoelectric source and receiver 18 as being in the enclosed area 13, and the outer door 11 closes, a non-emergency level audible alarm is provided. If, while the person is in the enclosed area 13, the metal detector 17 is activated, indicating the presence of a gun or other weapon, the emergency level audible alarm will sound. The operator may then enter his password or fingerprint plus press the emergency key 33 to invoke the Warning Status or he may enter just his password to open the inner door 12 and not set the Warning Status.

If the metal detector 17 did not activate, the operator, using his password or fingerprint, must then make a judgement on the intent of the person entering and either unlock the inner door 12 or the operator may then enter his password and fingerprint plus press the emergency key 33 to invoke the Warning Status. If the operator unlocks the inner door 12 and the person enters through the inner door 12, the outer door 11 will lock upon opening the inner door 12, but if he decides to re-exit, the inner door 12 will lock upon opening the outer door 11. Upon exiting and the outer door 11 reclosing, the inner door 12 will again unlock. If the person has chosen to continue entering through the inner door 12, the outer door 11 would have remained locked until the inner door 12 had reclosed after the person passed through the inner door 12 into the establishment. When the person enters through the inner door 12 into the enclosed area 13, the outer door 11 having been locked by opening the inner door 12 and is detected by the tread switch 16 and verified by the infrared photoelectric source and receiver 18 as being in the enclosed area 13, and the inner door 12 closes, a low level audible alarm is provided to the operator. The operator, using his password or fingerprint, may then unlock the outer door 11 allowing the person to egress, or the person may chose to turn around and reenter through the inner door 12. If the person continues to egress through the outer door 11, the inner door 12 will lock upon opening the outer door 11, but if the person decides to reenter through the inner door 12, the outer door 11 will lock upon opening the inner door 12. Upon exiting and the outer door 11 reclosing, the inner door 12 will again unlock. If the person had chosen to continue egressing through the outer door 11, the inner door 12 would have remained locked until the outer door 11 had reclosed after the person passed through it out of the establishment. Mode 4 provides the highest level of security for the establishment and the operator, however, it also requires the most operator intervention.

When the Warning Status is entered, either by activation by the metal detector 17 or by operator selection, the outer door 11 will immediately lock and stay locked. In addition, the output interface 47 will actuate and electrically lock all other doors throughout the establishment. The inner door 12, however, remains unlocked, so the person for whom the Warning Status was initiated may continue to enter the establishment through the inner door 12. Later when the person attempts to exit the establishment by passing through the inner door 12 (on the way out of the establishment) and is detected in the enclosed area 13 by activation of the tread switch 16 and the infrared photoelectric source and receiver 18, the inner door 12 will also lock upon closure, entrapping the person in the enclosed area 13. The operator annunciator 44 will signal this condition to the operator and require that the operator input his password or fingerprint to release the lock on the outer door 11 or unlock the inner door 12 by keying in "A" plus the password or fingerprint. If the system does not receive the password or fingerprint within a preprogrammed time, the system will then activate the telephone interface device 42 to notify the alarm company. After another preprogrammed time period, typically several hours, the Warning Status automatically cancels and the system returns to its previous mode.

Cancellation of the Warning Status depends on how the Warning Status was invoked. The Warning Status can be invoked by the following:

1. by metal detector 17 activation which sets a metal detector flag—to cancel the Warning Status when the metal detector flag is set, requires that the measured amount of metal (a measure of the amount of guns or other weaponry) that entered the establishment must be equal to the measured amount of metal which leaves the establishment; and
2. other cases which do not set the metal detector flag—when the metal detector flag is not set, the Warning Status can be cancelled by a permissive control setup. The permissive control setup is a group of parameters which include:
   - Setup 1: a preprogrammed time period after which the Warning Status may be cancelled by the operator (password+302 in FIG. 7);
   - Setup 2: the Warning Status could have been invoked by pressing the emergency key 33 plus a number. The number reflects the number of persons in the establishment, which the operator wishes to have leave the establishment, before the Warning Status can be cancelled. The number of persons in this case will usually be small, because a dangerous situation will usually not occur when there are several persons in the establishment;
   - Setup 3: the Warning Status may be cancelled by a reprogram code from the alarm company after the alarm company has verified that there is no emergency at the establishment; and
   - Setup 4: the Warning Status can be cancelled .at any time by the operator by keying in his password or fingerprint.

In addition to the above-identified ways to cancel the Warning Status, there is also the situation where a person has been entrapped in the enclosed area 13 and the operator has been incapacitated. In this case, after the activation of the telephone interface device 42 and a programmed time period has elapsed, typically of several hours, the Warning Status will automatically cancel.

Figure 10:
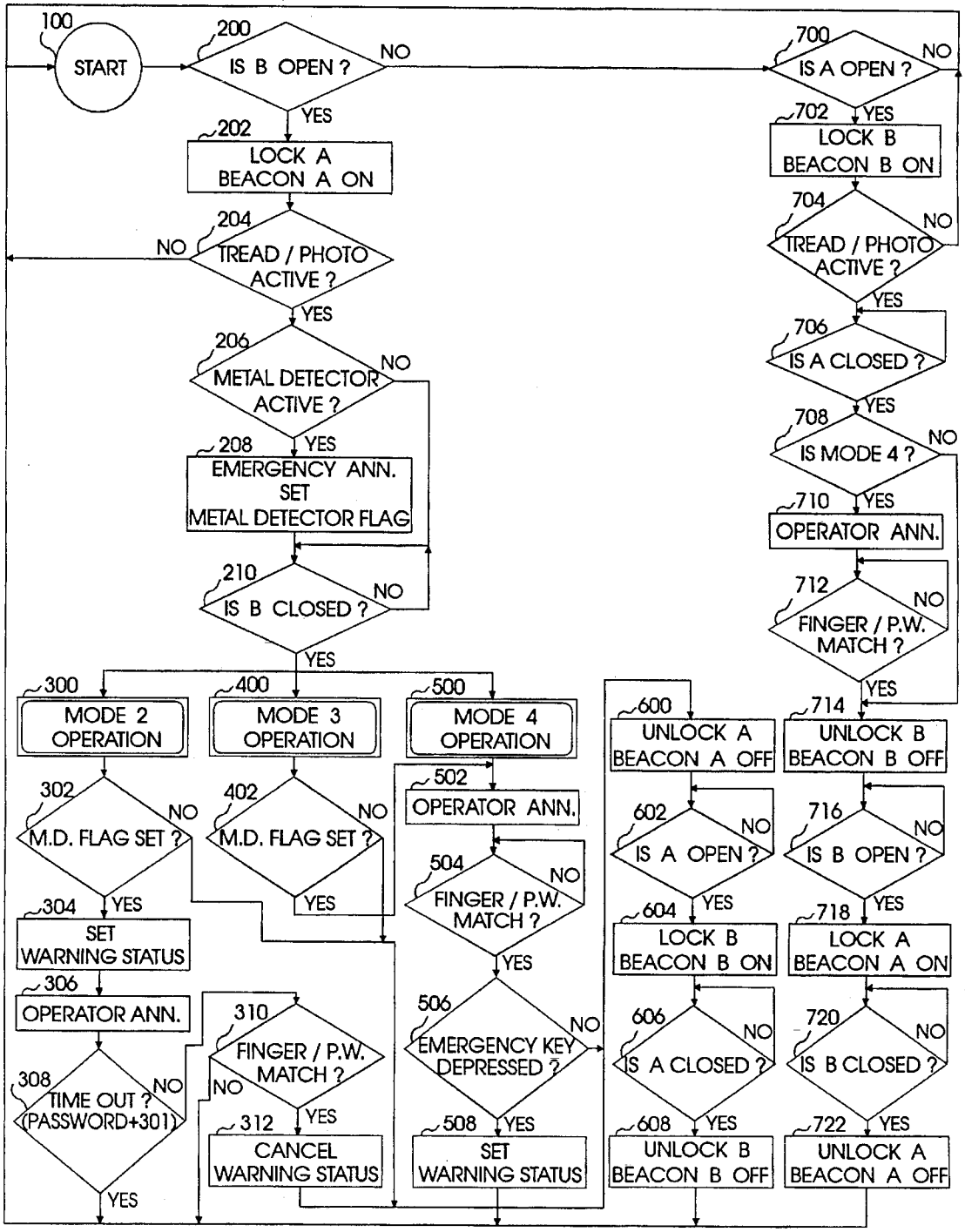
FIG. 10 is a flow chart illustrating the logic performed by the central processing unit of the security system of the present application for modes 2–4.

FIG. 10 is a flow chart illustrating the control steps executed by the central processing unit (CPU) 40, in order to control the anti-crime security system of the present application. Once the CPUI 40 is initialized in step 100, the CPU 40 then checks whether the outer door (B) is open in step 200. If the outer door (B) is open, then in step 202 the CPU locks the inner door (A) and sets the beacon 19 for the inner door (A) such that it displays "WAIT". In step. 204, the CPU 40 determines whether the tread switch 16 or photodetector 18 is active. If not, the CPU 40 returns to initialization step 100. If either of the tread switch 16 or photodetector 18 are active, then in step 206, the CPU 40 determines whether metal detector 17 is active. If the metal detector 17 is active, in step 208, the CPU 40 activates the emergency annunciator 43, sets the metal detector flag and proceeds to step 210. If the metal detector 17 is not active in step 206, then the CPU 40 proceeds directly to step 210. In step 210, the CPU 40 determines whether the outer door (B) is closed. If the outer door (B) is closed, then the CPU 40 may put the security system of the present application in any of modes 2, 3, or 4.

If the system is in mode 2, at step 200, first, the CPU 40 checks to see if the metal detector flag is set is step 302. If the metal detector flag is set, then the CPU 40 places the security system into the Warning Status in step 304 and activates the operator annunciator 44 in step 306. If the CPU 30 times out in step 308, after a predetermined time, the CPU 40 is returned to the initialization step 100. If the CPU 40 does not time out in step 308, in step 310, the CPU 40 determines whether a fingerprint or password match is received. If not, the CPU 40 returns the system to the initialization step 100, if a match is received in step 310, the CPU 40 cancels the Warning Status.

In mode 3 operation, the CPU 40 first checks the metal detector flag in step 402. If the metal detector flag is set, the system is placed in mode 4 operation. In mode 4, the CPU 40 first activates the operator annunciator 44 in step 502 and then checks for a fingerprint or password match in step 504. If there is a match, the CPU 40 determines whether the emergency key 33 was depressed in step 506. If the emergency key 33 was depressed, the CPU 40 places the system in Warning Status and returns to the initialization step 100. If the Warning Status is cancelled in step 312, or if the metal detector flag is not set in step 402 or if the emergency key 33 was not depressed in step 506, the CPU 40 proceeds to step 600 and unlocks the inner door (A) and turns the inner door (A) beacon 19 off. In step 602, the CPU 40 determines whether the inner door (A) is open. If the inner door (A) is open, then in step 604, the CPU 40 locks the outer door (B) and turns the beacon 19 for the outer door (B) to "WAIT". In step 606, the CPU determine whether the inner door (A) is closed and if so, in step 608, unlocks the outer door (B) and turns the outer door (B) beacon off and returns to the initialization step 100.

If, in step 200, the CPU 40 determines that the outer door (B) is not open, processing proceeds to step 700, where the CPU 40 determines whether the inner door (A) is open. If not, the CPU 40 returns to the initialization step 100. If the inner door (A) is open, then in step 702, the CPU 40 locks the outer door (B) and turns the beacon 19 for the outer door (B) to "WAIT". In step 704, the CPU 40 determines whether either the tread switch 16 or photodetector 18 has been activated. If not, processing returns to the initialization step 100, if so, then step 706, the CPU 40 determines whether the inner door (A) is closed. If the inner door (A) is closed, then in step 708, the CPU 40 determines whether the security system is in mode 4. If the system is in mode 4, the operator annunciator 44 is activated in step 710 and the CPU 40 checks for a finger print or password match in step 712. If there is a finger print or password match in step 712, in step 714, the CPU 40 unlocks the outer door (B) and turns the outer door (B) beacon 19 off. If, in step 708, the system is not in mode 4, then the CPU 40 jumps directly to step 714. In step 716, the CPU 40 determines whether the outer door (B) is open, and if so, in step 718, locks the inner door (A), turns the inner door (A) beacon 19 to "WAIT". In step 720, the CPU 40 determines whether the outer door (B) is closed and if so, in step 722, unlocks the inner door (A), turns the inner door (A) beacon 19 off, and returns to the initialization step 100.

Figure 11:
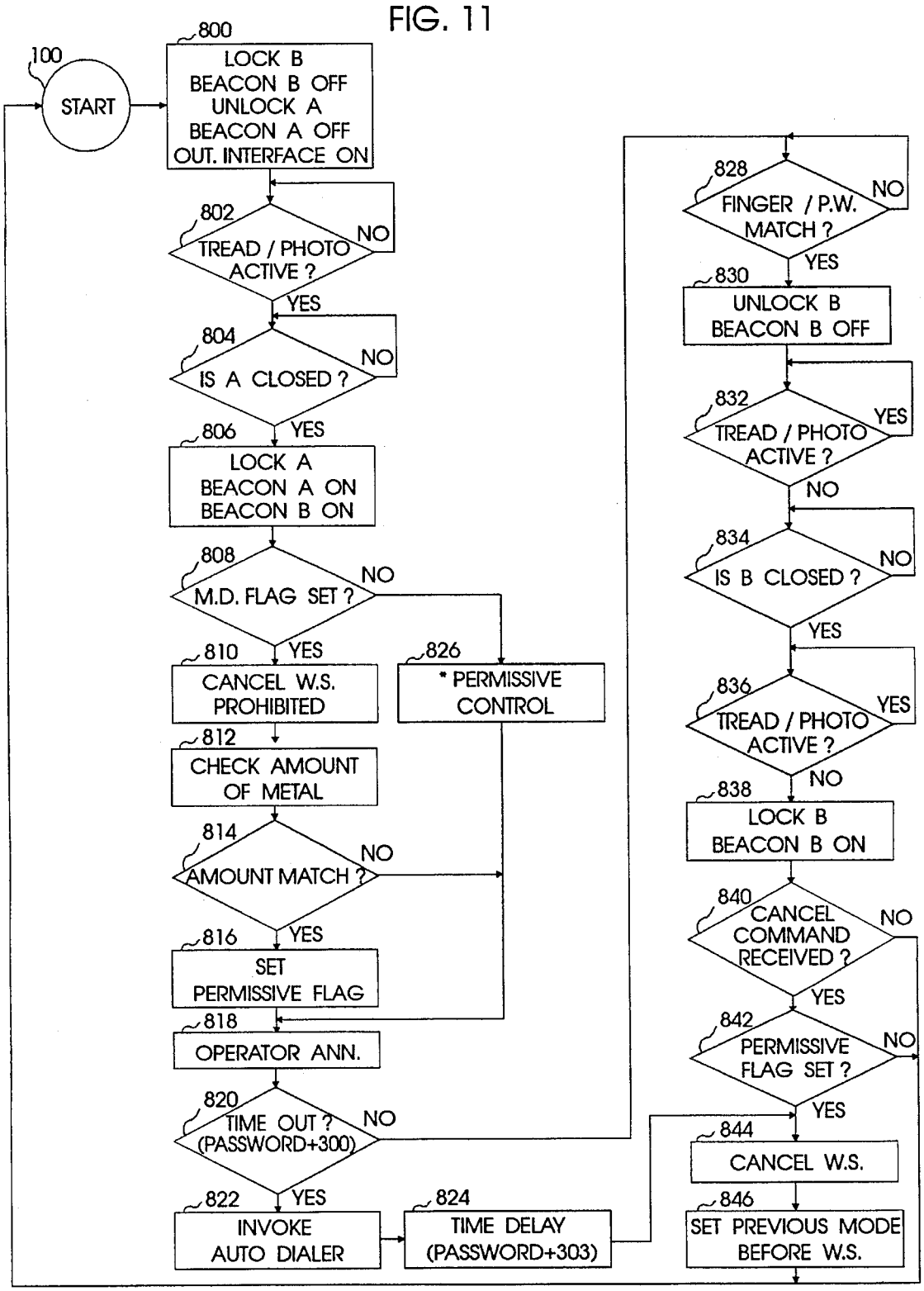
FIG. 11 is a flow chart illustrating the logic performed by the central processing unit of the security system of the present application in the warning status.

FIG. 11 is a flow chart illustrating the control steps executed by the CPU 40 associated with the Warning Status. Once the CPU 40 is initialized in step 100, in step 800, the outer door (B) is locked, the outer door (B) beacon is turned off, the inner door (A) is unlocked, the inner door (A) beacon is turned off, and the output interface 47 is turned on. In step 802, the CPU 40 determines whether the tread switch 16 or photodetector 18 has been activated. If so, in step 804, the CPU 40 determines whether inner door (A) is closed. If so, in step 806, the CPU 40 locks the inner door (A) turns the inner door (A) beacon 19 to "WAIT" and turns the outer door (B) beacon 19 to "WAIT". In step 808, the CPU 40 determines whether the metal detector flag has been set. If so, in step 810, the CPU 40 prohibits the cancellation of the Warning Status, in step 812, checks the amount of metal detected, and in step 814, determines whether the amount of metal entering equals the amount of metal leaving. In step 816, a permissive flag is set and in step 818, the operator annunciator 44 is activated.

If in step 808, the metal detector flag is not set, in step 826, the CPU 40 allows permissive control to cancel the Warning Status, by one of the four techniques, namely setup 1–4, discussed above. Once permissive control of the Warning Status is completed, or the metal entering the enclosed area 13 does not equal the metal leaving the enclosed area 13 in step 814, the CPU 40 jumps directly to step 818 and activates the operator annunciator 44. In step 820, if the CPU 30 time period times out, then in step 822, the telephone interface device 42 is invoked. In step 824, if another time delay to cancel the Warning Status expires, the CPU 40 jumps to step 844. If in step 820, the CPU 30 has not timed out, the CPU 40 proceeds to step 828 in order to determine whether a fingerprint or password match has occurred. If so, in step 830, the CPU 40 unlocks the outer door (B) and turns the outer door (B) beacon 19 off. In step 832, the CPU 40 determines whether the tread switch 16 or photodetector 18 was activated. If not, in step 834, the CPU 40 determines whether the outer door (B) is closed. If so, then step 836, the CPU 40 again determines whether the tread switch 16 or photodetector 18 has been activated. If not, in step 838, the CPU 40 locks the outer door (B) and sets the outer door (B) beacon 19 to "WAIT". In step 840, if a cancel command has been received, in step 842, the CPU 40 determines whether the permissive flag has been set. If so, the Warning Status is cancelled in step 844 and the CPU 40 returns the system to its previous mode, before the Warning Status was worked. Also, if the time delay in step 824 expires, then the Warning Status is canceled in step 844 and the CPU 40 returns the system to its previous mode, before the Warning Status was invoked. If in step 840 the cancel command is not received or in step 842, the permissivie flag is not set, the system returns to the initialization step 100.

As described above, the present invention relates to an anti-crime security system which includes double doors and a computer controlled system to lock and unlock the doors based on sensor input of prevailing conditions. The system will prevent criminal activity two ways, one by actually detecting the possibility of weapons on persons attempted to enter a building and limiting their ingress, and secondly, by deterring even an attempt at criminal activity, by having the would-be perpetrator know of the serious limitations to a successful escape after having committed a crime.

The invention being thus described, it will be obvious that the same may be varied in many ways. Such variations are not to be regarded as a departure from the spirit and scope of the invention and all such modifications as would be obvious to one skilled in the art are intended to be included within the scope of the following claims.

We claim:

1. An anti-crime security system, comprising:

access means for providing an entrance and an exit to an establishment and for defining an enclosed area;

sensor means for monitoring ingress and egress of a perpetrator through said access means and conditions within said establishment; and central processing means for receiving input from said sensor means regarding the ingress and egress of the perpetrator and the conditions within said establishment and for controlling said access means such that when the perpetrator is inside the establishment and then a warning status is established, the perpetrator must reenter the enclosed area in order to exit the establishment, wherein the enclosed area is bounded by inner and outer doors which are automatically locked when the perpetrator reenters the enclosed area, whereupon an operator of said anti-crime security system controls a locking mechanism of the inner and outer doors, and the perpetrator cannot exit the enclosed area if a control panel of said anti-crime security system is disabled or the operator of said anti-crime security system is disabled or killed.

2. The anti-crime security system of claim 1, said access means including a double-door system including the inner door and outer door, which with two parallel sidewalls, define said enclosed area.

3. The anti-crime security system of claim 2, wherein said central processing means controls said access means such that said inner door and said outer door cannot be unlocked simultaneously.

4. The anti-crime security system of claim 1, said sensor means including, person detecting means for detecting a person in said enclosed area; and metal detecting means for detecting a metal object in said enclosed area.

5. The anti-crime security system of claim 4, wherein, when said metal detecting means detects the metal object, said central processing means activates an emergency alarm and places said security system in a warning status.

6. The anti-crime security system of claim 5, wherein when said central processing means places said security system in the warning status, the warning status may only be deactivated by subsequent detection of the metal object by said metal detecting means.

7. The anti-crime security system of claim 4, said person detecting means including a tread switch and a photosensor.

8. The anti-crime security system of claim 1, wherein the establishment is a grocery store or a convenience store.

9. The anti-crime security system of claim 1, said central processing means operating in a plurality of operating modes, which vary in degree of security provided and operator intervention required.

10. The anti-crime security system of claim 9, wherein said central processing means places said security system in the warning status from any of said plurality of operating modes, when any one of a plurality of conditions are detected.

11. The anti-crime security system of claim 10, wherein said plurality of conditions include activation of an emergency key, activation of an audio sensor, and a crash door opening.

12. The anti-crime security system of claim 11, wherein the audio sensor is activated by a gun shot.

13. The anti-crime security system of claim 10, wherein the warning status may be deactivated if a person is detected in said enclosed area.

14. The anti-crime security system of claim 1, wherein said central processing means may be accessed only with proper identification.

15. The anti-crime security system of claim 14, wherein the proper identification includes one of a password and an authorized finger print.

16. The anti-crime security system of claim 15, wherein the password depends partly or completely on a system time clock.

17. The anti-crime security system of claim 1, said security system further comprising:

operator annunciator means for generating an audible signal to an operator of said security system;

emergency annunciator means for generating an audio signal, audible throughout the establishment; and telephone interface means for contacting an external party when an external signal is generated by said central processing means.

18. The anti-crime security system of claim 1, said security system further comprising:

fire detection means for disabling said central processing means and said access means if a fire is detected in said establishment.

19. The anti-crime security system of claim 1, said central processing means including a central processing unit.

20. An anti-crime security system for an establishment, comprising:

access means for providing an entrance and an exit to the establishment and for defining an enclosed area, wherein the enclosed area is bounded by an inner door and an outer door; and central processing means which operates in a plurality of operating modes, each automatically correlated with different degrees of traffic flow into the establishment and thereby providing different degrees of security for the establishment; wherein the plurality of operating modes are set to a time schedule identified by an operator of said anti-crime security system to control said access means, in response to traffic flow during a time of day, wherein the plurality of operating modes include a first mode wherein either or both of the inner door and the outer door can be opened; a second mode wherein one door cannot be opened unless the other door is closed and locked; a third mode wherein the inner door cannot be opened when a sensor inside said enclosed area detects a dangerous object that is being brought into the establishment; and a fourth mode wherein either the inner door or the outer door is locked and can be opened only with intervention by the operator; wherein said central processing means operates in only one of the plurality of operating modes at any given time.

* * * * *